United States Patent [19]

Auer et al.

[11] Patent Number: 4,878,877

[45] Date of Patent: Nov. 7, 1989

[54] PLUG-IN MODULE FOR MOTORIZED TOY VEHICLE

[75] Inventors: Robert T. Auer, East Stroudsburg, Pa.; David Reina, Maplewood, N.J.

[73] Assignee: Buddy L Corporation, New York, N.Y.

[21] Appl. No.: 242,265

[22] Filed: Sep. 9, 1988

Related U.S. Application Data

[63] Continuation-in-part of Ser. No. 122,253, Nov. 16, 1987.

[51] Int. Cl.[4] ..... A63H 29/24; A63H 29/20; A63H 17/26; F16H 3/34

[52] U.S. Cl. ..... 446/463; 446/443; 446/470; 74/335; 74/354

[58] Field of Search ..... 446/90, 93, 94, 95, 446/440, 442, 443, 448, 449, 457, 460, 461, 462, 463, 468, 431, 439, 456, 470, 471, 484; 273/86 B; 74/202, 335, 354

[56] References Cited

U.S. PATENT DOCUMENTS

| | | | |
|---|---|---|---|
| 2,131,877 | 10/1938 | King | 446/461 X |
| 2,664,167 | 12/1953 | Östergren | 74/202 X |
| 3,041,485 | 6/1962 | Jolley | 446/462 X |
| 3,659,378 | 5/1972 | Tong | 446/443 X |
| 3,818,632 | 6/1974 | Tong | 446/443 |
| 4,218,846 | 8/1980 | Lahr | 446/460 X |
| 4,378,709 | 4/1983 | Chitayat | 74/202 X |
| 4,406,085 | 9/1983 | Rhodes | 446/456 |
| 4,511,343 | 4/1985 | Goldfarb et al. | 446/457 X |
| 4,516,648 | 5/1985 | Berger et al. | 446/442 X |
| 4,540,380 | 9/1985 | Kennedy et al. | 446/463 |
| 4,570,502 | 2/1986 | Klatt | 74/335 |

FOREIGN PATENT DOCUMENTS

| | | | |
|---|---|---|---|
| 1197365 | 8/1961 | Fed. Rep. of Germany | 446/443 |
| 154547 | 9/1982 | Japan | 74/354 |

OTHER PUBLICATIONS

"In New Products", *Product Engineering*, vol. 30, No. 1, p. 53.

*Primary Examiner*—Robert A. Hafer
*Assistant Examiner*—D. Neal Muir
*Attorney, Agent, or Firm*—Michael Ebert

[57] ABSTRACT

A power module which when plugged into an open compartment in the body of a motorless toy vehicle acts to motorize the vehicle, the compartment being disposed above a coupling gear which is operatively linked to a wheel or other means to propel the vehicle. Pivotally supported within the case of the module is a DC motor and a gear assembly having attached thereto a control lever. A battery supply housed in the case is connected to the motor through a normally open switch that closes to power the motor when the control lever which normally is in a neutral mode, is shifted either to a forward mode in which the assembly is then inclined to drive the vehicle in the forward direction, or to a reverse mode in which the assembly is then oppositely inclined to drive the vehicle in the reverse direction. The assembly includes a worm gear on the motor shaft and a pair of drive pinions engaging the worm gear on either side thereof whereby the pinions are caused to rotate concurrently in opposite directions. In the neutral mode, neither pinion engages the coupling gear and the vehicle is then free wheeling. In the forward mode, the coupling gear is engaged by only one drive pinion to cause forward motion of the vehicle, and in the reverse mode, the coupling gear is engaged only by the other drive pinion to cause reverse motion of the vehicle.

7 Claims, 4 Drawing Sheets

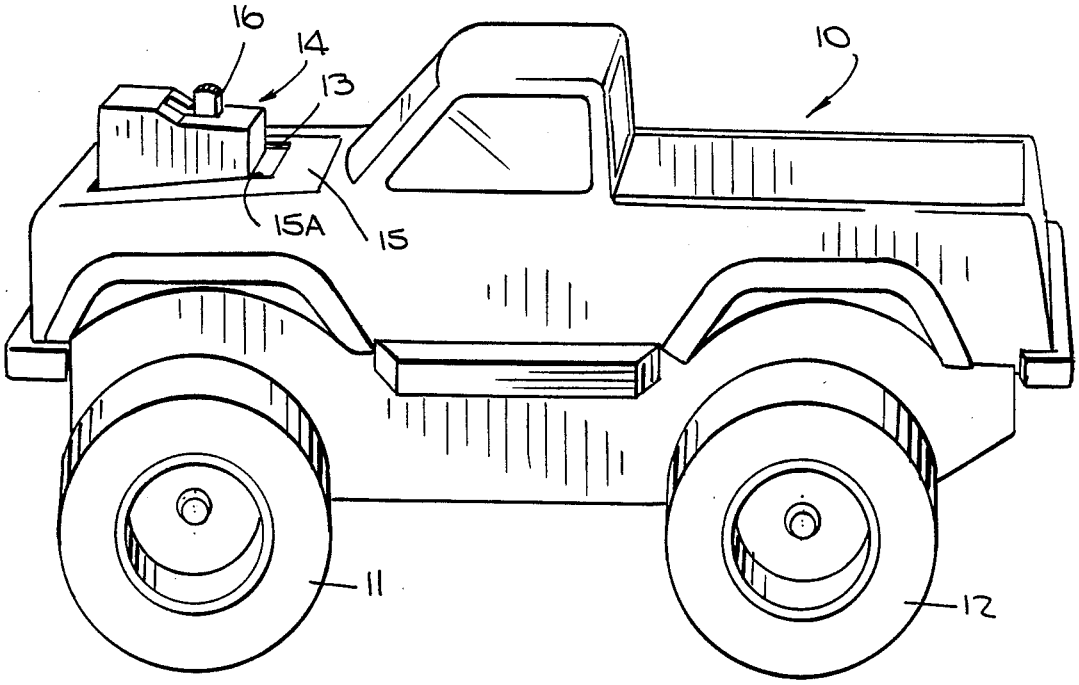
Fig. 1.
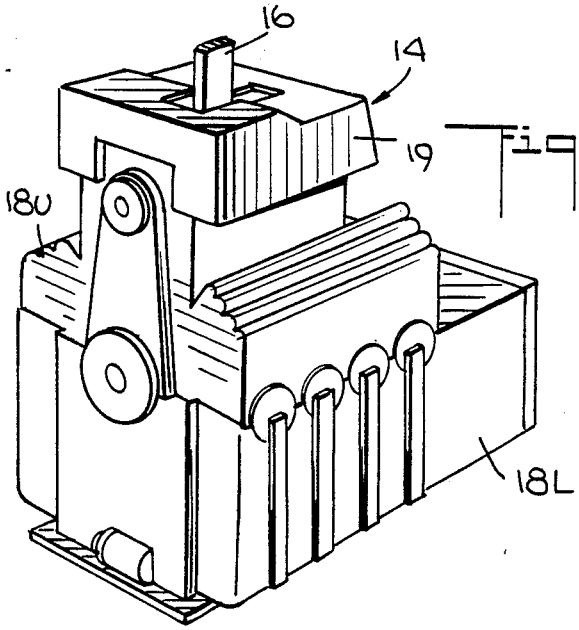
Fig. 2.
Fig. 3.
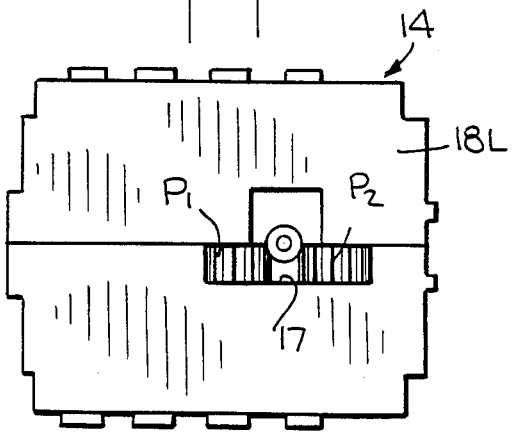

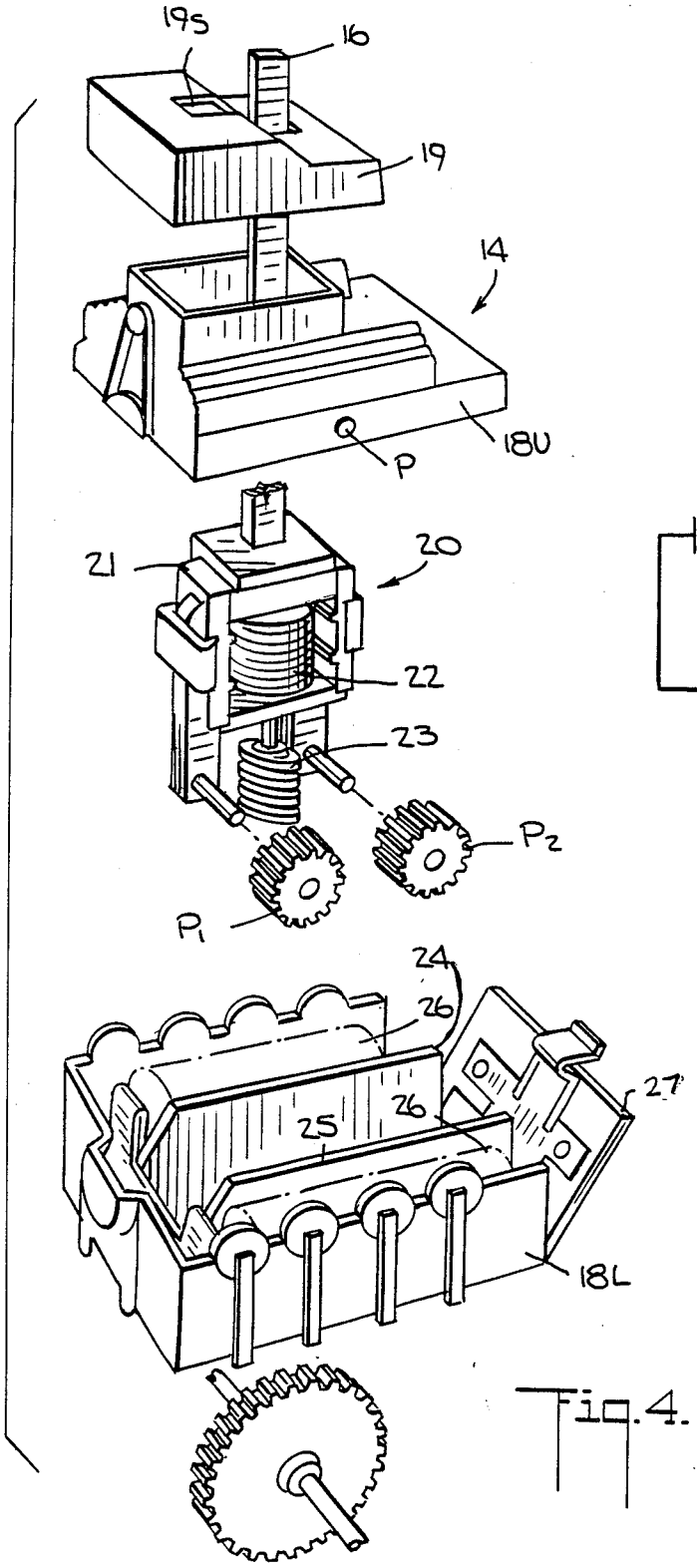
Fig. 4.
Fig. 5.
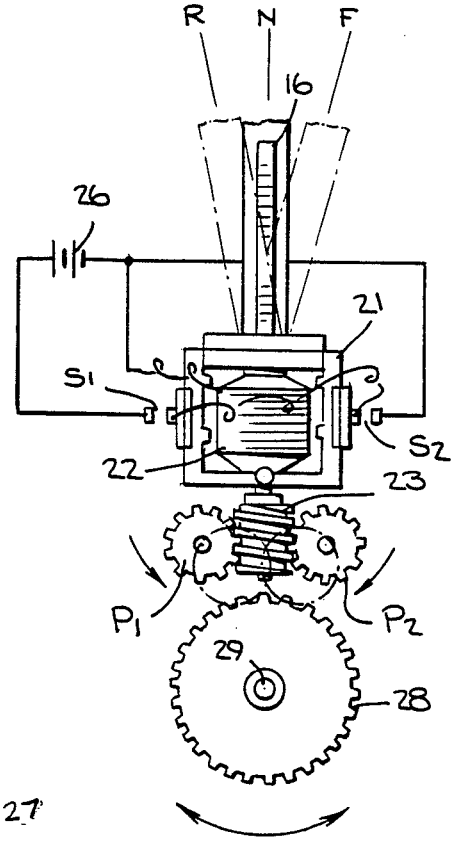

PLUG-IN MODULE FOR MOTORIZED TOY VEHICLE

This application is a continuation-in-part of our copending application of the same title, Ser. No. 122,253 filed Nov. 16, 1987, the entire disclosure of which is incorporated herein by reference.

BACKGROUND OF INVENTION

1. Field of Invention

This invention relates generally to motorized toy vehicles provided with a battery-powered DC motor, and more particularly to a self-sufficient power module which encases the motor and a battery supply therefor, the module being pluggable into an open compartment in the body of any one of a family of motorless toy vehicles, the module then acting to motorize the vehicle to drive it in either the forward or reverse mode whereby the same power module is usable to propel all vehicles in the family.

2. Status of Prior Art

The term "vehicle" as used herein encompasses all forms of transportation, such as an automobile or truck whose wheels propel the vehicle, a boat having a propeller, or a helicopter having a propeller.

The typical motorized toy vehicle includes a miniature DC motor connected through a polarity-reversing switch to a battery supply. In the case of an automobile or truck, the motor is operatively geared to at least one wheel axle, so that when the motor is switched on, the vehicle is propelled in a direction that depends on the polarity of the applied voltage. In the case of a toy boat, the motor is operatively coupled to paddle wheels or a propeller, depending on the nature of the boat.

In play, children usually seek as best they can to initiate an observed adult activity. Play, therefore, represents a learning experience that prepares the child for the adult world. Thus, a child who plays with a toy combat weapon prefers a toy whose appearance resembles that of an actual weapon, and a child who plays with toy cars or trucks is happiest with those that behave and look like vehicles of the type he has seen driven by adults.

Also, children enjoy playing with an assortment or family of different vehicles such as cars, trucks, trailers, buses, tractors and other vehicles normally encountered on the road, for each vehicle has a specialized function and therefore calls for a play activity appropriate to this function. But should one wish to provide a child with a group of different motorized toy vehicles each having its own motor and battery supply, the overall cost of this group of toys will necessarily be high; for the motor, the battery supply and the gear train to link the motor to a wheel axle represent a substantial portion of the manufacturing cost of the vehicle.

In our copending patent application, above-identified, there is disclosed a power module which when plugged into an open compartment in the body of a motorless toy vehicle and switched on, then acts to drive the vehicle in a selected direction.

In our prior arrangement, the compartment is disposed above a coupling gear mounted on a wheel axle of the vehicle. The case of the module simulates the appearance of a multi-cylinder engine and houses DC motor and a battery supply therefor, the motor being operatively coupled to a single drive pinion whose teeth project below the base of the case to engage the coupling gear whereby when the motor is energized, the wheel axle is caused to turn to propel the vehicle. The upper end of the case which projects above the body has a rocker pivoted thereon which simulates an air scoop for the engine and functions as the actuator for a polarity-reversing switch connecting the battery supply to the motor.

When the rocker is inclined down toward the front, the resultant switching action causes forward motion of the vehicle, the vehicle moving in the reverse direction when the rocker is inclined down toward the rear. When the rocker is in its neutral position, the battery supply is disconnected from the DC motor, hence the car is then stationary. However, since in the neutral position, the pinion of the module is still in mesh with the coupling gear of the vehicle, the wheel axle on which this gear is mounted is not free to turn and the car is not then free wheeling.

Children, when playing with motorized vehicles will, in order to vary their play activity, seek to propel the vehicle by hand, so that instead of switching on the motor, the player gives the vehicle a strong push. This alternative play action is possible if the vehicle, when the motor is turned off, is free wheeling. But in a motorized vehicle of the type disclosed in our copending application, the drive pinion of the pluggedin power module is always in engagement with the coupling gear of the vehicle and the vehicle is never free wheeling; hence should the child attempt to propel the vehicle by hand, he may, in doing so, damage the gear works and render the vehicle inoperative.

SUMMARY OF INVENTION

In view of the foregoing, the main object of this invention is to provide a power module which when plugged into an open compartment in the body of a motorless toy vehicle, such as a truck, an automobile or a boat, then acts to motorize the vehicle to drive it either in the forward or reverse direction, or acts to render the vehicle free wheeling so that the player, if he elects to do so, may propel the vehicle by hand without inflicting any damage to the vehicle.

Thus, with a plug-in module in accordance with the invention, three modes of play activity are possible when the power module is plugged in; namely motorized forward drive, motorized reverse drive, or free wheeling.

A significant feature of the invention is that the appearance of the plug-in power module, to the extent that it is exposed to the viewer,suggests that of a standard multi-cylinder internal combustion engine, the upper section of the module which is provided with a control lever projecting above the body of the toy vehicle and being visible to the player; as a consequence of which the player enjoys the experience of installing this familiar engine in a toy vehicle and of controlling its operation.

More specifically, an object of the invention is to provide a power module of the above type which can be plugged into an open compartment in a family of diverse toy vehicles each having an open motor compartment so that the same power module functions to drive any selected vehicle in the family.

An important economic advantage of the invention is that the manufacturing cost of each vehicle in the family thereof is relatively low, for none of the vehicles includes a DC motor, a battery supply therefor, and a gear train to operatively couple the motor to a wheel axle or other means to propel the vehicle; for these elements are all housed in a single module usable with any vehicle in the family.

Briefly stated, these objects are attained in a power module which when plugged into an open compartment in the body of a motorless toy vehicle acts to motorize the vehicle, the compartment being disposed above a coupling gear which is operatively linked to a wheel or other means to drive the vehicle. Pivotally supported within the case of the module is a DC motor and a gear assembly having attached thereto a control lever. A battery supply housed in the case is connected to the motor through a normally-open switch that closes to operate the motor when the control lever which normally is in a neutral mode is shifted either to a forward mode in which the assembly is then inclined to drive the vehicle in the forward direction, or to a reverse mode in which the assembly is then oppositely inclined to drive the vehicle in the reverse direction.

The assembly includes a worm gear on either side thereof whereby the pinions are caused to rotate concurrently in opposite directions. In the neutral mode, neither pinion engages the coupling gear and the vehicle is then free wheeling. In the forward mode, the coupling gear is engaged by only one drive pinion to cause forward motion of the vehicle, and in the reverse mode, the coupling gear is engaged only by the other drive pinion to cause reverse motion of the vehicle.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a preferred embodiment of the invention which takes the form of a toy pick-up truck having an open compartment into which is pluggable a power module;

FIG. 2 is a separate front view, in perspective, of the power module;

FIG. 3 is a bottom view of the power module showing the exposed drive pinions;

FIG. 4 is an exploded view of the power module;

FIG. 5 illustrates the relationship of the power module pinions to the coupling gear of the vehicle when the plugged-in module is in neutral;

DESCRIPTION OF INVENTION

Basic Structure of First Embodiment

Figure 6:
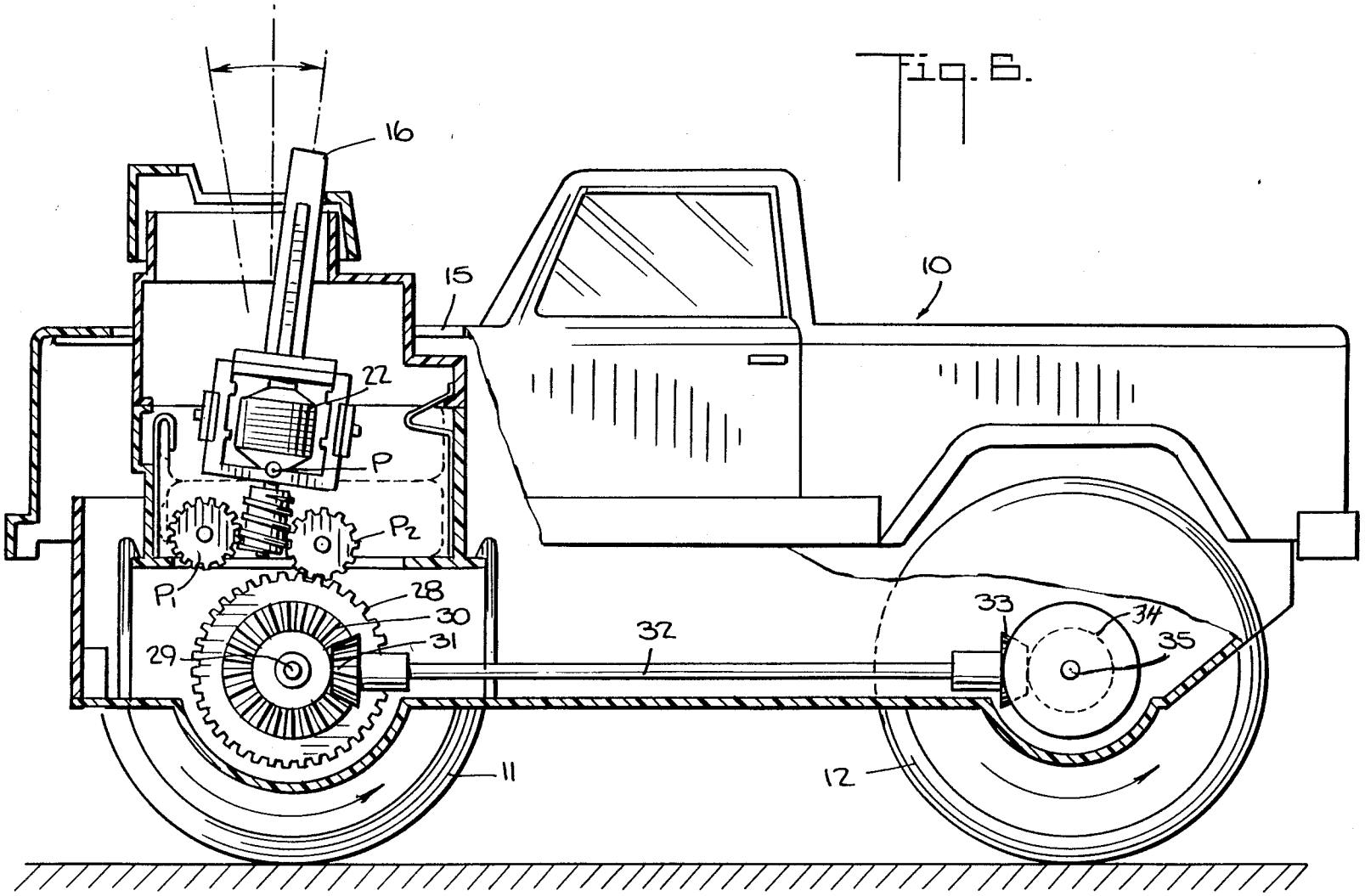
FIG. 6 shows the power module plugged into the vehicle, with the module in its forward mode.

Referring now to FIG. 1, there is shown a preferred embodiment of a motorless toy pick-up truck 10 having front and rear wheel sets 11 and 12. Provided at the front of the vehicle body where normally an engine is housed, is an open compartment 13 adapted to receive a plug-in module 14. Also included is a hinged hood 15 having a rectangular opening 15A to accommodate the upper section of the module from which extends a control lever 16.

Thus, to install the power module, one must first raise hood 15, then plug power module 14 into compartment 13 and close the hood thereover, at which point the power module is in its operative state. The power module, as best seen in FIG. 2, is configured to resemble a multi-cylinder internal combustion engine.

Pivotally supported within the power module is a battery-powered DC motor and gear assembly that includes a pair of drive pinions $P_1$ and $P_2$ whose teeth are exposed, as shown in FIG. 3, through an opening 17 in the base of the module case. Below the open compartment is the front wheel axle of truck 10 on which is mounted a coupling gear.

The arrangement is such, as will later be explained in greater detail, that when control lever 16 of power module 14 occupies its neutral mode N, the battery supply housed in the module case is then disconnected from the motor and the drive pinions $P_1$ and $P_2$ are then disengaged from the vehicle coupling gear so that in this mode, the vehicle is free wheeling.

But when control lever 16 is shifted to incline the motor and gear assembly to operate in the forward mode F, this action closes a switch connecting the power supply to the motor which causes drive pinions $P_1$ and $P_2$ to rotate concurrently in opposite directions, only pinion $P_1$ then engaging the coupling gear to drive the vehicle in the forward direction. And when control lever 16 is shifted to oppositely incline the assembly to operate in the reverse mode R, this action again closes a supply switch to operate the motor, but this time only pinion $P_2$ engages the coupling gear to drive the vehicle in the reverse direction.

Thus, the toy vehicle, when the power module is plugged therein, is capable of operating selectively in the neutral free wheeling mode, or in a motorized forward or reverse mode.

Power Module (first version)

As shown in FIGS. 4 and 5, power module 14 is provided with a molded plastic case having a box-like lower section 18L which is joined to an upper section 18U to create a form resembling that of a multi-cylinder internal combustion engine having an array of four cylinders on one side and a like array on the other side.

Fitting over the open top of upper section 18U of the case through which extends control lever 16 is a cover 19 whose form is such as to simulate an air scoop for the engine. Cover 19 has a slot 19S therein to accommodate lever 16 which projects thereabove.

Pivotally supported within the case by a pivot pin P is a motor and gear assembly 20 within whose frame 21 is supported a miniature DC motor 22 on whose shaft is mounted a worm gear 23. The opposite sides of gear 23 are engaged to drive pinions $P_1$ and $P_2$ so that when the motor is energized to turn worm gear 23, the drive pinions are then caused to rotate in opposite directions. Thus, pinion $P_1$, as shown in FIG. 5, rotates in the counterclockwise direction as pinion $P_2$ turns clockwise.

Lower section 18L of the module case is partitioned by parallel walls 24 and 25, as shown in FIG. 4, to define a center compartment for accommodating the motor and gear assembly, and side compartments to accommodate the batteries 26 of a battery supply for the motor. Lower section 18L is provided with a HINGED LID 27 to provide access to the battery compartments, the lid having contacts on its inner surface which engage the battery terminals.

Battery supply 26, as shown schematically in FIG. 5, is connected to motor 22, either through a switch $S_1$ or a switch $S_2$. Switch $S_1$ is formed by a movable contact mounted on the left side of assembly frame 21 and a fixed contact engaged by this movable contact when pivoted assembly 20 is inclined by lever 16 to its forward mode (F) position. Switch $S_2$ is formed by a movable contact mounted on the right side of the assembly frame 21 and a fixed contact engaged by this movable contact when the pivoted assembly 20 is oppositely inclined by lever 16 to its reverse mode (R) position. Hence, the motor is connected to the battery supply in both the forward and reverse mode, but not in the neutral mode when both switches are open.

When the module is plugged into the open compartment of a vehicle, it is then in operative relation to a coupling gear 28 mounted on a front or rear wheel axle 29. In practice, coupling gear 28 may be a conventional toothed gear, but in lieu thereof it may take the form of a wheel having an O-ring tire to provide friction drive.

In the neutral mode position N, as shown in FIG. 5, control lever 16 and assembly 21 to which it is attached are vertically oriented. In this neutral position, pinions $P_1$ and $P_2$ are symmetrically disposed on either side of the axis of coupling gear 18 and are spaced from the coupling gear so that in neutral mode N, the vehicle is free wheeling, and the power module motor is turned off.

When pivoted assembly 21 is inclined rearwardly by control lever 16 and is in the F mode, then motor 22 is energized and rotating drive pinion $P_1$ is brought into engagement with coupling gear 28 to drive the vehicle in the forward direction. Shifting control lever 16 to the R mode again causes motor 22 to be energized, but this time it is pinion $P_2$ which is brought into engagement with coupling gear 28; and because pinion $P_2$ rotates in a direction which is the reverse of that of pinion $P_1$, the vehicle is then driven in the reverse direction.

The Powered Vehicle

FIG. 6 shows the power module installed in the compartment of truck 10, the module motor and gear assembly being switched by lever 16 to operate in the forward mode F.

In this mode, pinion $P_2$ is in engagement with coupling gear 28 on front wheel axle 29. In order to provide four wheel drive, coupling gear 28 is provided at one side with a ring gear 30 that is engaged by a bevel gear 31 on the front end of a horizontal power transmission shaft 32 having a bevel gear 33 at its rear end. Rear bevel gear 33 engages COUPLING GEAR 34 on the rear axle 35 of the vehicle.

Should the vehicle when being propelled by the power module be prevented from moving because of an obstacle in its path or because the player grasps the vehicle to prevent it from moving, this action will prevent rotation of the coupling gear in the vehicle. As a result, the rotating pinion of the module then engaging the arrested coupling gear will be forced to disengage therefrom to decouple the power module and thereby prevent damage thereto. This is made possible because the pinion is included in the pivotally-supported gear assembly and is therefore free to swing away from the arrested coupling gear.

In practice, instead of four wheel drive, the vehicle may be made to operate with rear wheel drive, in which case coupling gear 28 is freely mounted on the front wheel axis 29, so that it acts as an idler gear to transmit the drive to the rear wheels.

The power module lends itself to use in any motorless vehicle provided with an open compartment which is positioned above a coupling gear mounted on a wheel axle. In practice, one may provide a player with a group or family of different toy vehicles such as buses, trucks, tractors and a variety of other toy vehicles, and a common plug-in power module to power any of these vehicles. In this way, the child is afforded a broad range of play possibilities to maintain his interest.

A vehicle included in the group may incorporate hoists and other motor-driven expedients which can be selectively coupled to the drive pinion of the module so that the player can pick up loads or carry out other play activities. And the vehicle may take the form of a toy boat whose propeller is coupled to the drive pinion of the plug-in module. Also, the power module may be used to power toys which simulate crane trailers, coal conveyors, hydraulic lifts and other types of industrial or farm equipment.

Figure 7:
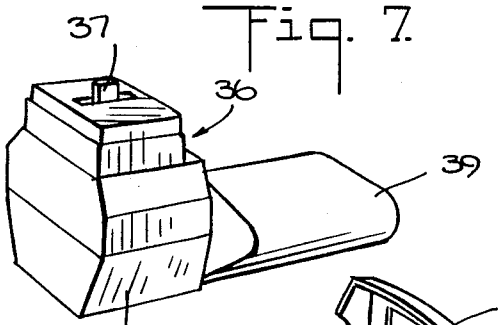
FIG. 7 shows another embodiment of a power module in accordance with the invention.

Referring now to FIG. 7, another version of a power module 36 in accordance with the invention is shown. In terms of its internal mechanism and function, power module 36 is essentially the same as the power module shown in the preceding figures and it includes an operating lever 37. This lever is shiftable by an operator from the neutral or free-wheeling mode to either a forward mode in which the coupling wheel 38 on the axle of the vehicle driven by the module (see FIG. 8) is engaged by one pinion of the pivoted DC motor and gear assembly, or to a forward mode in which the other pinion engages the coupling wheel.

The main difference is that in the second version of the power module, the two batteries for powering the motor, instead of being housed at positions on either side of the motor and gear assembly as in the first version, are housed in an extension 39 projecting rearwardly from case 40 which houses this assembly. In all other respects, the first and second versions of the power modules have the same internal mechanism and work in the same manner.

Figure 8:
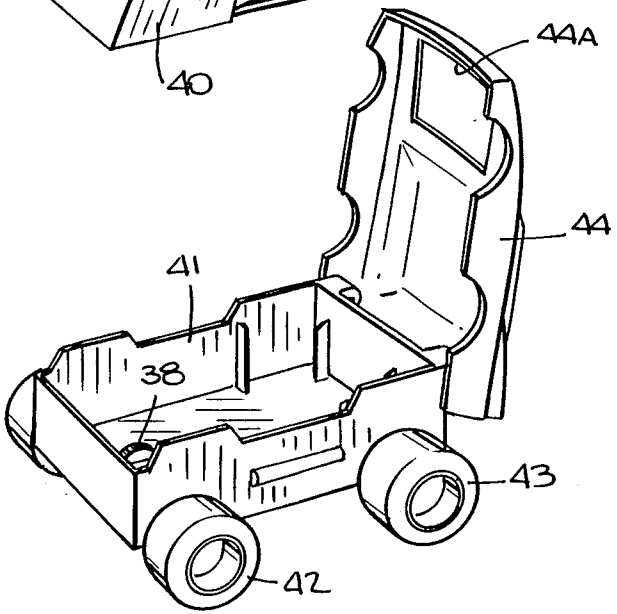
FIG. 8 shows a toy automobile adapted to accommodate the power module of FIG. 7, the vehicle having a body which is pivoted to the rear of the vehicle chassis to provide access to the motor compartment.

FIG. 8 shows a motorless vehicle to accommodate the power module shown in FIG. 7 and to be driven thereby. This vehicle includes a box-like chassis 41 from which the front wheels 42 and rear wheels 43 are supported. Coupling gear 38 is mounted on the front wheel axle and its teeth are exposed at the bottom of the compartment defined by the chassis, the dimensions of which are appropriate to the power module 36.

Figure 9:
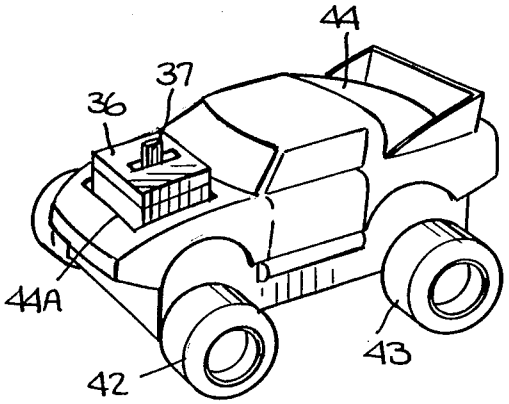
FIG. 9 shows the installed power module in the vehicle of FIG. 8.

Body 44 of the vehicle is hinged to the rear wall of chassis 41, so that when this body is swung open, as shown in FIG. 8, it gives access to the chassis compartment in which the power module is to be installed. Body 44 is provided with an opening 44A through which is projected the upper section of the installed module and lever 37. When, as shown in FIG. 9, body 44 is swung down over the installed power module, the engine-like upper section of the power module is then exposed, giving the impression of a high-powered vehicle.

Power Boat

Figure 10:
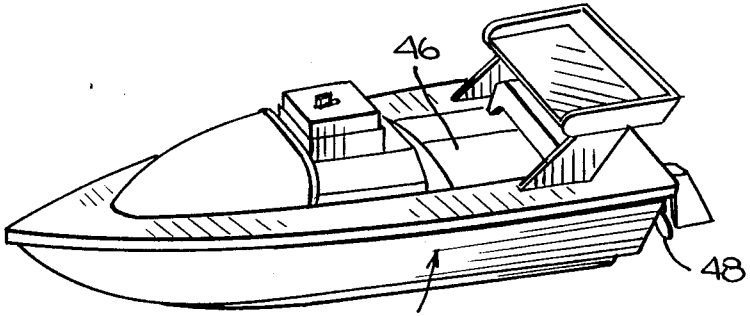
FIG. 10 shows, in perspective, a toy boat powered by the plug-in power module.
Figure 11:
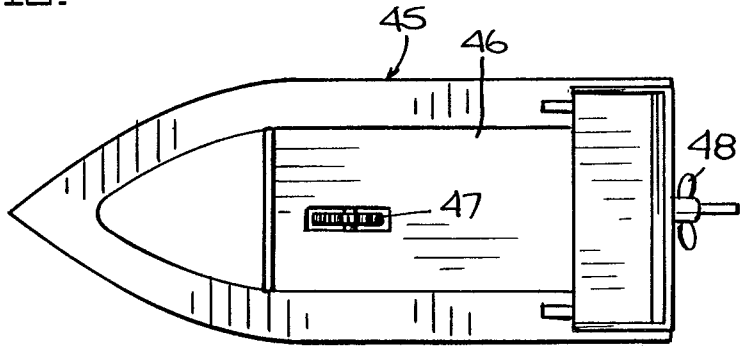
FIG. 11 is a plan view of this boat with the power module removed.

Referring now to FIGS. 10 and 11, there is shown a toy boat 45 having an open cockpit 46 providing an open compartment to accommodate a power module of the type shown in FIG. 7. Mounted for rotation on the floor of the compartment is a coupling gear 47 which is operatively linked to a propeller 48 extending behind the stern of the boat to propel the boat in water.

Hence, in this instance when the module is installed, the operator of the boat can shift the lever to the forward mode to propel the boat in the forward direction, or to the reverse mode to propel the boat in the reverse direction.

Thus, the same power module may be plugged into a toy automobile, a toy boat or any other land, sea or air toy vehicle adapted to accommodate the powermodule and including a coupling gear which is engaged by either pinion of the power module, which coupling gear is linked to whatever drive or other operating means are possessed by the vehicle to be powered by the module.

While there have been shown and described preferred embodiments of a plug-in module for motorized toy vehicle in accordance with the invention, it will be appreciated that many changes and modifications may be made therein without, however, departing from the essential spirit thereof. Thus, in lieu of a power module in which the motive force is supplied by a DC motor that is battery-operated, one may provide a wind-up coiled spring motor, thereby dispensing with the need for batteries and electrical switch contacts, and making possible a more compact, lighter and less expensive module. The key for winding the spring motor could be a separate piece or locked to the motor. Thus, the air scoop on top of the module could be made to function as a turnable wind-up key.

As with power modules which use DC motors, a power module of the spring motor type could be plugged into any one of a family of vehicles. Thus, the module could be plugged into a toy airplane fabricated primarily of light weight styrofoam, the module when plugged in acting to drive a propeller to provide a toy flying machine.

We claim:

1. A power module adapted to be installed in an open compartment in the body of a motorless toy vehicle to drive the vehicle in a desired direction, said compartment being disposed above a coupling gear operatively linked to a drive wheel, the module comprising:

A. a case having a base and housing a battery supply; and

B. a DC motor and gear assembly pivotally supported within the case having a control lever attached thereto which normally is positioned in a neutral non-driving mode, the lever being selectively shiftable either to a forward mode for driving the vehicle in the forward direction in which the assembly is then inclined with respect to the neutral mode, or to a reverse mode for driving the vehicle in the opposite direction in which the assembly is then oppositely inclined, said assembly being provided with a worm gear on a shaft of the motor and a pair of drive pinions engaging the worm gear on either side thereof, said pinions being positioned at an opening in said base adjacent said coupling gear, whereby when the motor is connected to said supply, the pinions are caused to rotate concurrently in opposite directions, only one of said pinions engaging the coupling gear in the forward mode and only the other pinion engaging the coupling gear in the reverse mode, both pinions being disengaged from the coupling gear in the neutral mode.

2. A power module for a vehicle as set forth in claim 1, in which the vehicle is provided with front and rear wheel shafts and said coupling gear is mounted on one of these shafts to drive the wheel on this shaft.

3. A power module as set forth in claim 1, further including a switch connecting said supply to said motor, said switch being operatively coupled to said pivotally supported assembly whereby the switch is closed only when the module is either in its forward or reverse mode.

4. A module as set forth in claim 1, wherein said case is molded to resemble the appearance of a multi-cylinder internal combustion engine.

5. A module as set forth in claim 4, wherein said case has a box-like lower section which houses said battery supply, and an upper section configured to resemble the engine block of the engine.

6. A module for a vehicle as set forth in claim 2 in which said coupling gear is on a front wheel axle and is operatively coupled to a second coupling gear on a rear wheel axle to effect four wheel drive of the vehicle.

7. A power module adapted to be installed in an open compartment in the body of a motorless toy vehicle to drive the vehicle in a desired direction, said compartment being disposed above a coupling gear operatively linked to a drive wheel, the module comprising:

A. a case having a base; and

B. a motor and gear assembly pivotally supported within the case and having a control lever attached thereto which normally is positioned in a neutral non-driving mode, the lever being selectively shiftable either to a forward mode for driving the vehicle in the forward direction in which the assembly is then inclined with respect to the neutral mode, or to a reverse mode for driving the vehicle in the opposite direction in which the assembly is then oppositely inclined, said assembly being provided with a worm gear on a shaft of the motor and a pair of drive pinions engaging the worm gear on either side thereof, said pinions being positioned at an opening in said base adjacent said coupling gear, whereby when the motor is energized, the pinions are caused to rotate concurrently in opposite directions, only one of said pinions engaging the coupling gear in the forward mode and only the other pinion engaging the coupling gear in the reverse mode, both pinions being disengaged from the coupling gear in the neutral mode.

* * * * *